US009941589B2

(12) United States Patent
Iwahashi et al.

(10) Patent No.: US 9,941,589 B2
(45) Date of Patent: Apr. 10, 2018

(54) NON-CONTACT COMMUNICATION ANTENNA, COMMUNICATION DEVICE, AND METHOD FOR MANUFACTURING NON-CONTACT COMMUNICATION ANTENNA

(71) Applicant: Sony Corporation, Tokyo (JP)

(72) Inventors: Mitsugi Iwahashi, Kanagawa (JP); Jinichi Morimura, Kanagawa (JP); Hiroyuki Takubo, Chiba (JP); Makoto Watanabe, Kanagawa (JP); Hiroshi Uchida, Tokyo (JP)

(73) Assignee: Sony Corporation, Tokyo (JP)

( * ) Notice: Subject to any disclaimer, the term of this patent is extended or adjusted under 35 U.S.C. 154(b) by 106 days.

(21) Appl. No.: 14/221,731

(22) Filed: Mar. 21, 2014

(65) Prior Publication Data

US 2014/0292610 A1 Oct. 2, 2014

(30) Foreign Application Priority Data

Mar. 29, 2013 (JP) ..... 2013-073978

(51) Int. Cl.
*H01Q 1/22* (2006.01)
*H01Q 1/38* (2006.01)
*H01Q 7/00* (2006.01)

(52) U.S. Cl.
CPC ..... *H01Q 7/00* (2013.01); *H01Q 1/2225* (2013.01); *H01Q 1/38* (2013.01); *Y10T 29/49016* (2015.01)

(58) Field of Classification Search
CPC ..... H01Q 1/2225; H01Q 7/00; H01Q 1/38; H01Q 1/242; H01Q 1/243; H01Q 1/2208; H01Q 1/2216; H01Q 9/27; B32B 2519/02; G08B 13/2442; G08B 13/242
USPC ..... 343/895, 867; 235/491, 492, 493; 340/572.1, 572.5
See application file for complete search history.

(56) References Cited

U.S. PATENT DOCUMENTS 4,498,076 A * 2/1985 Lichtblau ..... G08B 13/242 340/572.3
4,689,636 A * 8/1987 Tait ..... H01Q 1/36 343/895
4,835,524 A * 5/1989 Lamond ..... G08B 13/242 340/572.3
5,108,822 A * 4/1992 Imaichi ..... G08B 13/2414 29/592.1
5,841,350 A * 11/1998 Appalucci ..... G08B 13/242 340/572.3

(Continued)

FOREIGN PATENT DOCUMENTS

JP 2010-258381 A 11/2010

*Primary Examiner* — Hoang Nguyen
*Assistant Examiner* — Awat Salih
(74) *Attorney, Agent, or Firm* — Chip Law Group

(57) ABSTRACT

There is provided a non-contact communication antenna including a first antenna pattern that is formed on one surface of a base material, and a second antenna pattern that is formed on a back surface of the one surface of the base material. The first antenna pattern includes a first coil section and a first electrode section. The second antenna pattern includes a second coil section and a second electrode section. Capacitance of the first electrode section and the second electrode section compensates a change in capacitance depending on a formation situation of the first coil section and the second coil section.

14 Claims, 8 Drawing Sheets

(56) References Cited

U.S. PATENT DOCUMENTS

| | | | | |
|---|---|---|---|---|
| 6,313,747 | B2 * | 11/2001 | Imaichi | G08B 13/2414 29/25.42 |
| 6,951,621 | B2 * | 10/2005 | Hanhikorpi | G08B 13/2414 216/13 |
| 7,088,304 | B2 * | 8/2006 | Endo | G06K 19/0726 343/788 |
| 7,161,542 | B2 * | 1/2007 | Endo | G06K 19/0726 343/702 |
| 8,009,101 | B2 * | 8/2011 | Ikemoto | G06K 19/07749 343/700 MS |
| 9,077,067 | B2 * | 7/2015 | Ikemoto | H01Q 5/35 |
| 2007/0285252 | A1 * | 12/2007 | Johnson | G08B 13/2414 340/572.5 |
| 2008/0246664 | A1 * | 10/2008 | Ikemoto | G06K 19/07749 343/700 MS |
| 2009/0065588 | A1 * | 3/2009 | Aoki | G06K 19/07749 235/492 |
| 2012/0024959 | A1 * | 2/2012 | Minagawa | G06K 19/0772 235/488 |
| 2012/0217311 | A1 * | 8/2012 | Rokhsaz | G06K 19/0726 235/492 |

* cited by examiner

FIG. 9

| | | DEVIATION AMOUNT BETWEEN FRONT AND BACK SURFACES | | | | |
|---|---|---|---|---|---|---|
| | | -0.5mm | -0.3mm | ±0mm | +0.3mm | +0.5mm |
| PRESENT EMBODIMENT | ANTENNA FREQUENCY | 17.6 | 17.6 | 17.28 | 17.48 | 17.76 |
| | ANTENNA CAPACITY | 30.5022 | 30.6763 | 30.4627 | 30.5418 | 29.5465 |
| COMPARATIVE EXAMPLE | ANTENNA FREQUENCY | 21.2 | 20.85 | 18.55 | 19.55 | 20.1 |
| | ANTENNA CAPACITY | 22.5218 | 23.1988 | 28.6134 | 25.1441 | 24.8257 |

NON-CONTACT COMMUNICATION ANTENNA, COMMUNICATION DEVICE, AND METHOD FOR MANUFACTURING NON-CONTACT COMMUNICATION ANTENNA

CROSS REFERENCE TO RELATED APPLICATIONS

This application claims the benefit of Japanese Priority Patent Application JP 2013-073978 filed Mar. 29, 2013, the entire contents of which are incorporated herein by reference.

BACKGROUND

The present disclosure relates to a non-contact communication antenna, a communication device, and a method for manufacturing a non-contact communication antenna.

A portable terminal transferring signals to and from a reader/writer is provided with a radio frequency identification (RFID) antenna. In general, the RFID antenna is manufactured by: printing equivalent circuit patterns such as a coil and a capacitor by resist printing on both surface of a raw film, the raw film being obtained by laminating a conductor such as aluminum foil and copper foil on both surfaces of a flexible base material such as a plastic film; and removing (etching) areas on which the resist patterns are not printed using an etching solution such as iron oxides.

With regard to resist printing, a roll-to-roll method using a rotogravure printing machine, the method making it possible to perform continuous printing by comparison with a screen printing method, is often used from the viewpoint of cost (for example, see JP 2010-258381A).

SUMMARY

When antenna patterns are formed on the both surfaces of a raw film for an antenna, there is no printing deviation between a front surface and a back surface if the printing is performed normally. However, the printing deviation occurs between the front surface and the back surface if the printing is not performed normally. When the antenna patterns forming coils are formed on the both surfaces of the raw film for the antenna, there is change in overlap of conductor sections between the both surfaces of the antenna depending on accuracy in forming. Accordingly, capacitance of the antenna becomes unstable, and change in resonance frequency of the antenna increases.

Accordingly, the present disclosure provides a novel and improved non-contact communication antenna, communication device, and method for manufacturing a non-contact communication antenna that can suppress change in resonance frequency occurred during manufacturing processes in the case where antenna patterns forming coils are provided on the both surfaces.

According to an embodiment of the present disclosure, there is provided a non-contact communication antenna including a first antenna pattern that is formed on one surface of a base material, and a second antenna pattern that is formed on a back surface of the one surface of the base material. The first antenna pattern includes a first coil section and a first electrode section. The second antenna pattern includes a second coil section and a second electrode section. Capacitance of the first electrode section and the second electrode section compensates a change in capacitance depending on a formation situation of the first coil section and the second coil section.

According to an embodiment of the present disclosure, there is provided a method for manufacturing a non-contact communication antenna, the method including forming, on one surface of a base material, a first antenna pattern having a first coil section and a first electrode section, and forming, on a back surface of the one surface of the base material, a second antenna pattern having a second coil section and a second electrode section. The first electrode section formed in the first-antenna-pattern forming step and the second electrode section formed in the second-antenna-pattern forming step compensate a change in capacitance depending on a formation situation of the first coil section and the second coil section in the first-antenna-pattern forming step and the second-antenna-pattern forming step.

As described above, according to the present disclosure, there is provided a new and improved non-contact communication antenna, communication device, and method for manufacturing a non-contact communication antenna that can suppress change in resonance frequency occurred during manufacturing processes in the case where antenna pattern forming coils are provided on the both surfaces.

BRIEF DESCRIPTION OF THE DRAWINGS

FIG. 9 is an explanatory diagram showing a change in resonance frequency and capacitance by comparison.

DETAILED DESCRIPTION OF THE EMBODIMENT(S)

Figure 1:
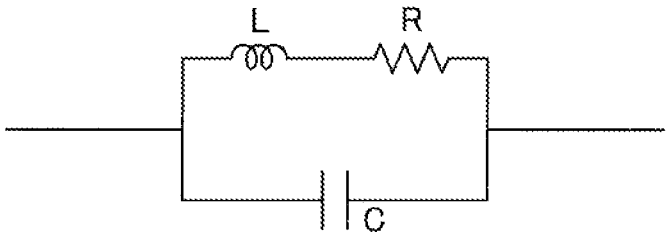
FIG. 1 is an explanatory diagram showing an LCR parallel resonance circuit.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that description will be provided in the following order.

<1. Existing RFID antenna>
<2. Embodiment of present disclosure>
[Configuration example of RFID antenna]
[Example of method for manufacturing RFID antenna]
[Example of change in resonance frequency]
<3. Conclusion>

1. Existing RFID Antenna

Before describing a preferable embodiment of the present disclosure in detail, a configuration of a generally existing RFID antenna is described first.

Among RFID, an equivalent circuit of an antenna used in ISO/IEC 18092 (NFC IP-1) whose carrier frequency is 13.56 Mhz is modeled as an LCR parallel resonance circuit. FIG. 1 is an explanatory diagram showing an LCR parallel resonance circuit that is the equivalent circuit of the antenna used in ISO/IEC 18092 (NFC IP-1) whose carrier frequency is 13.56 Mhz.

In FIG. 1, there is shown a coil having inductance L, a resistor having resistance R, and a capacitor having capacitance C. FIG. 1 also shows a state in which the coil and the resistor are connected in series and the coil and the resistor are connected with the capacitor in parallel.

In order to achieve such equivalent circuit as FIG. 1, with regard to a general RFID antenna, an equivalent circuit pattern of the coil that is inductance and the capacitor of a capacity component is formed on a raw film of a plastic film such as polyethylene terephthalate (PET), polyethylene naphthalate (PEN), and polyimide (PI), to which conductive foil (Al, Cu) is laminated on both surfaces. The equivalent circuit is formed by printing resist material on a surface of a conductor and by etching the conductor.

Figure 2:
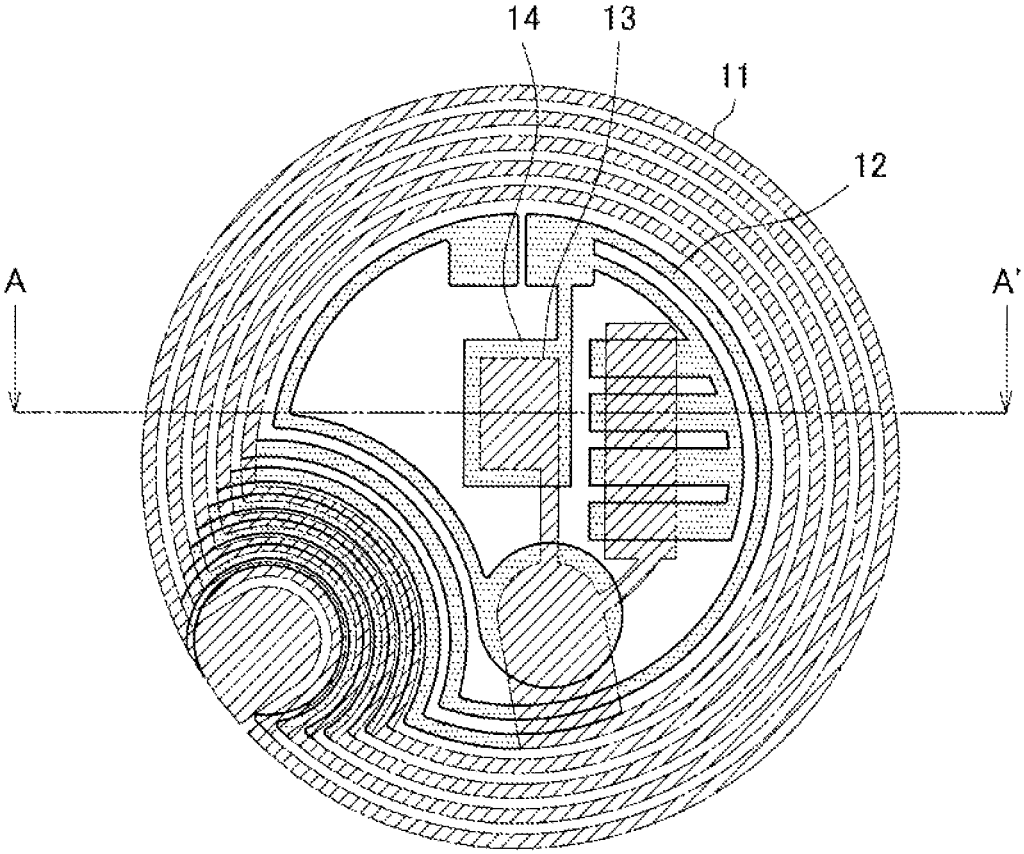
FIG. 2 is an explanatory diagram showing antenna patterns formed by an existing method.
Figure 3:
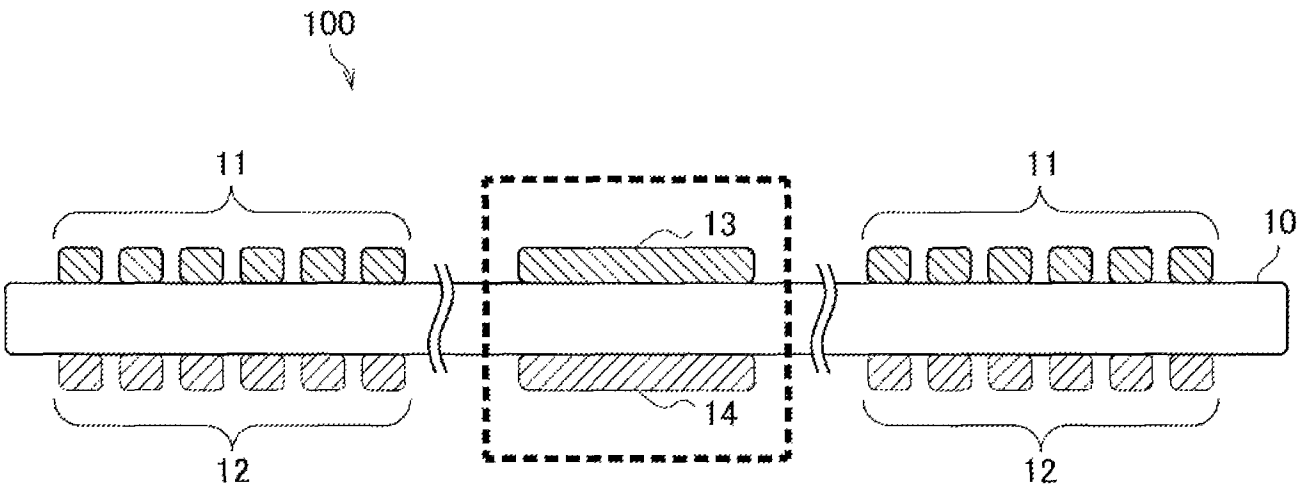
FIG. 3 is an explanatory diagram showing an cross section along a line A-A' of FIG. 2.

FIG. 2 is an explanatory diagram showing antenna patterns of an RFID antenna that is formed by an existing method, and FIG. 3 is an explanatory diagram showing an cross section along a line A-A' of FIG. 2.

A reference numeral 11 shown in FIG. 2 is a coil section formed on one surface of a film base material 10. A reference numeral 12 is a coil section formed on an opposite surface of the surface, on which the coil section 11 is formed, of the film base material 10. Reference numerals 13 and 14 are electrode sections that can generate predetermined capacitance.

As described above, capacitance of an antenna formed by printing resist material on surfaces of conductors and by etching the conductors is generated by matching a position of a front-side conductor and a position of a back-side conductor.

In the case where the coil sections 11 and 12 are respectively formed on the front surface and the back surface of the film base material 10 by printing resist material on the surfaces of the conductors using a roll-to-roll method, capacitance of a whole RFID antenna may change because of accuracy in printing antenna patterns on the front surface and the back surface of the raw film.

In the existing techniques, a maximum difference in forming antenna patterns between the front surface and the back surface of the film base material 10 is about ±0.5 mm from a position desired at a time of manufacturing. In other words, when antenna patterns are formed, the coil section 11 has a deviation of up to ±0.5 mm from the coil section 12. Here, a direction (flow direction) in which a raw film moves when an antenna pattern is formed using the roll-to-roll method is defined as a positive direction.

As shown in FIG. 2, regarding an RFID antenna having a small diameter which is less than or equal to 1 cm for example, each line width and space of the antenna is about 0.3 mm due to a restriction of a pattern layout and etching amount. Accordingly, the maximum difference of ±0.5 mm between the front surface and the back surface of the antenna patterns corresponds to a deviation of about one coil, and resonance frequency of the single antenna changes significantly.

The resonance frequency of the single antenna changes since capacitance of the coil sections 11 and 12 or capacitance of the electrode sections 13 and 14 are generated or disappeared according to the deviation in forming the antenna patterns on the front surface and the back surface. By this change in the resonance frequency, electric power received by an IC chip in RFID in which an antenna is mounted is changed. Accordingly, a communication range for communicating with a reader/writer becomes unstable.

In the following embodiment of the present disclosure, there will be described an RFID antenna and a method for manufacturing thereof, the RFID antenna being capable of suppressing change in resonance frequency by suppressing change in capacitance even if deviation in forming the antenna patterns on the front surface and the back surface occurs.

2. Embodiment of Present Disclosure

[Configuration Example of RFID Antenna]

Figure 4:
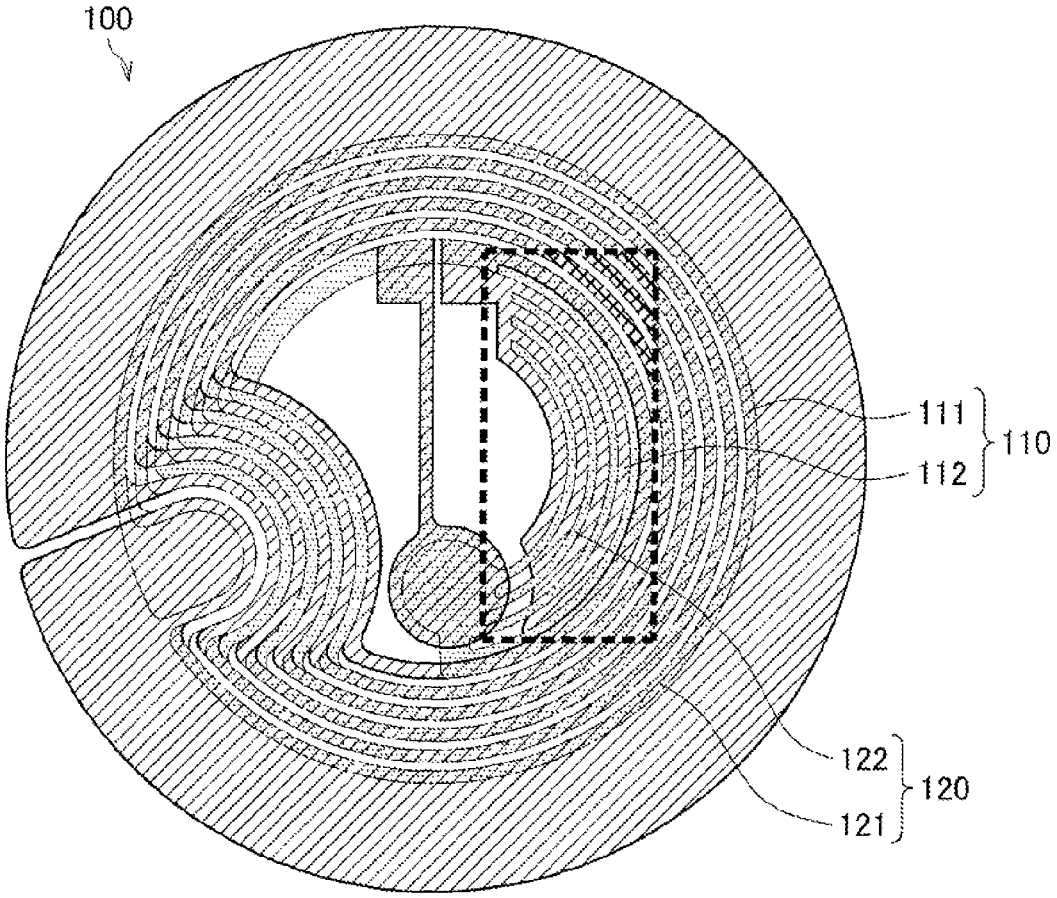
FIG. 4 is an explanatory diagram showing antenna patterns of an RFID antenna according to an embodiment of the present disclosure.

FIG. 4 is an explanatory diagram showing a configuration example of an RFID antenna according to an embodiment of the present disclosure. Hereinafter, there will be described the configuration example of the RFID antenna according to an embodiment of the present disclosure with reference to FIG. 4.

The configuration example of an RFID antenna 100 shown in FIG. 4 is a diagram showing the RFID antenna 100 viewed from one surface. As shown in FIG. 4, the RFID antenna 100 according to an embodiment of the present disclosure includes antenna patterns 110 and 120. The antenna pattern 110 includes a coil section 111 and an electrode section 112, and the antenna pattern 120 includes a coil section 121 and an electrode section 122. The antenna pattern 110 including the coil section 111 and the electrode section 112 may be formed on the one surface of a film base material 101 by resist printing. The antenna pattern 120 including the coil section 121 and the electrode section 122 may be formed on the opposite surface of the film base material 101 of the surface on which the antenna pattern 110 is formed by resist printing.

The coil sections 111 and 121 correspond to the coil having inductance L in the equivalent circuit shown in FIG. 1. The sum of capacitance generated by the coil section 111 and the coil section 121 and capacitance generated by the electrode section 112 and the electrode section 122 corresponds to capacitance C in the equivalent circuit shown in FIG. 1. In the example shown in FIG. 4, the coil section 111 and the coil section 121 are formed so that positions of the coils match each other on the both surfaces of the film base material 101.

The RFID antenna 100 may be manufactured by the roll-to-roll method using a rotogravure printing machine or the like. That is, for example, a conductive paste is pressed into grooves of fine line patterns in a gravure plate formed on a surface of a gravure cylinder, and the conductive paste is transferred on the both surfaces of the film base material 101 so that antenna patterns are formed on the both surfaces of the film base material 101. Subsequently, areas in which the resist pattern is not printed are removed (etched) by using an etching solution such as iron oxides so that the RFID antenna 100 is manufactured.

As described above, when antenna patterns are formed on the front surface and the back surface of the film base material 101 by using the roll-to-roll method, the antenna pattern may not be formed on a location desired at a time of manufacturing depending on accuracy in printing the antenna patterns on the front surface and the back surface of the film base material 101. If the antenna pattern is not formed on the location desired at the time of manufacturing, capacitance of the whole RFID antenna may change as described above.

Roles of the electrode section 112 and the electrode section 122 are to suppress the change in capacitance of the whole RFID antenna even if the antenna patterns 110 and 120 are not formed on the locations desired at the time of manufacturing.

The electrode section 112 and the electrode section 122 have a role to compensate, for capacitance generated by a position deviation, capacitance of the coil section 111 and 121 lost by the position deviation in the case where positions of coils of the coil section 111 and the coil section 121 do not match each other on the both surfaces of the film base material 101 when the antenna patterns 110 and 120 are formed.

Figure 5:
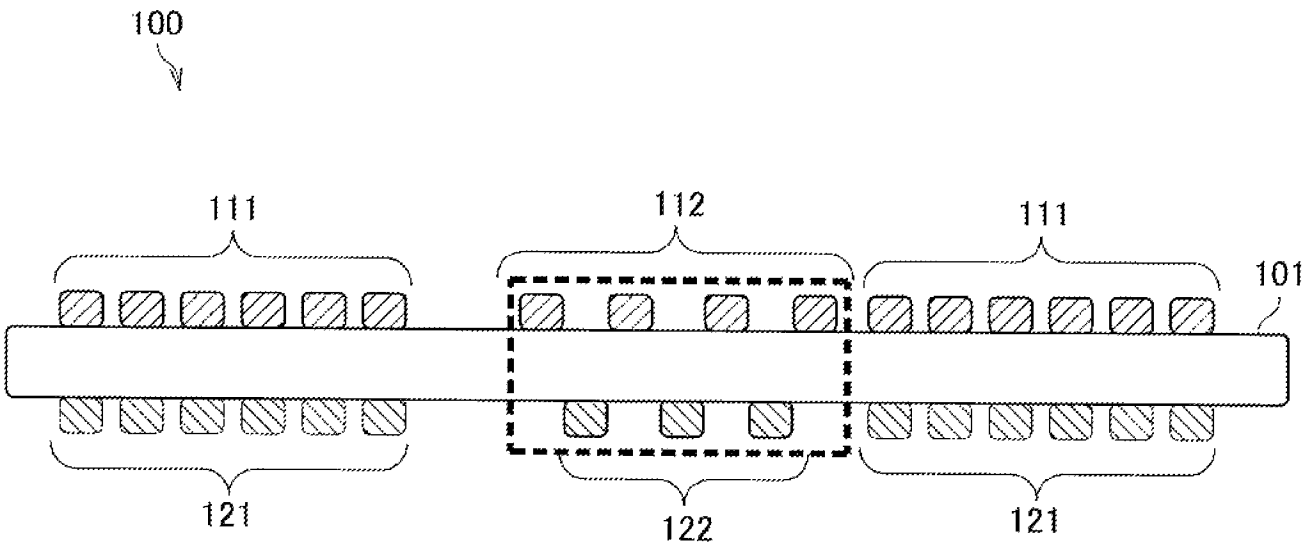
FIG. 5 is an explanatory diagram showing an example of a cross section of an RFID antenna 100 shown in FIG. 4.

FIG. 5 is an explanatory diagram showing an example of a cross section of the RFID antenna 100 shown in FIG. 4. FIG. 5 shows an example of the cross section of the RFID antenna in the case where the antenna patterns 110 and 120 are formed on locations desired at the time of manufacturing.

As shown in FIG. 5, when the antenna patterns 110 and 120 can be formed on the locations desired at the time of manufacturing, the positions of the coils of the coil sections 111 and 121 match each other on the both surfaces of the film base material 101. On the other hand, when the antenna patterns 110 and 120 can be formed on the locations desired at the time of manufacturing, positions of the electrode sections 112 and 122 do not match each other on the both surfaces of the film base material 101.

As described above, when the antenna patterns 110 and 120 can be formed on the locations desired at the time of manufacturing, capacitance is generated by the coil sections 111 and 121, and capacitance is not generated by the electrode sections 112 and 122. At a time of designing antenna patterns, the antenna patterns having appropriate resonance frequency is designed on an assumption that the antenna patterns 110 and 120 can be formed on the locations desired at the time of manufacturing.

Figure 6:
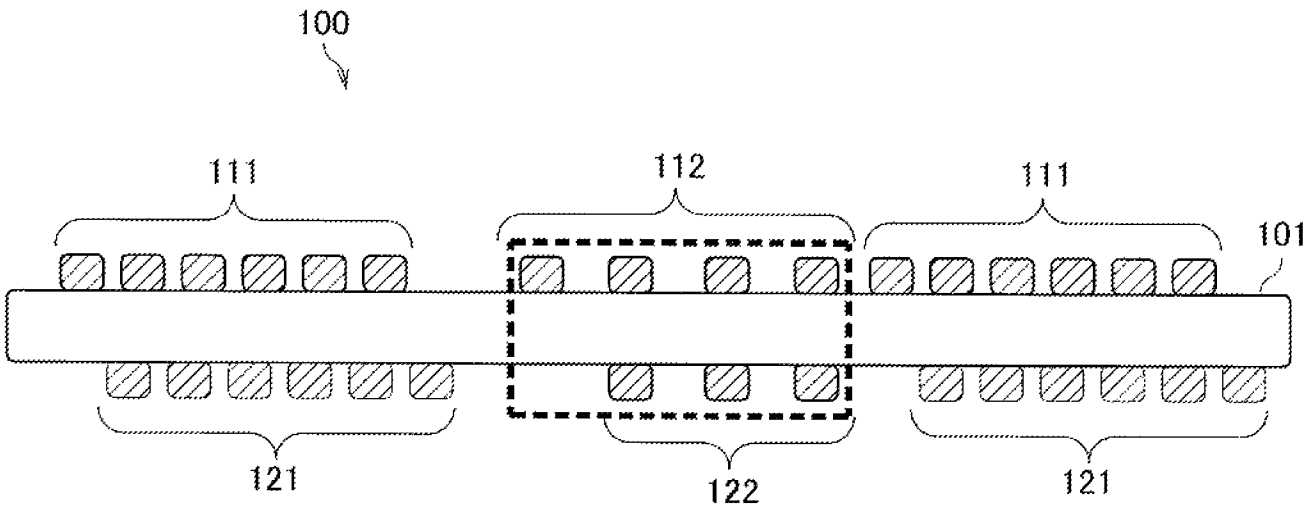
FIG. 6 is an explanatory diagram showing an example of a cross section of an RFID antenna 100 shown in FIG. 4.

However, in the case where the antenna patterns 110 and 120 are not formed on the locations desired at the time of manufacturing, capacitance of the coil sections 111 and 121 decrease by comparison with a case where the antenna patterns 110 and 120 can be formed on the locations desired at the time of manufacturing. FIG. 6 is an explanatory diagram showing an example of a cross section of the RFID antenna 100 shown in FIG. 4. FIG. 6 shows the example of the cross section of the RFID antenna in the case where the antenna patterns 110 and 120 are not formed on the locations desired at the time of manufacturing.

As shown in FIG. 6, when the antenna patterns 110 and 120 are not formed on the locations desired at the time of manufacturing, positions of coils of the coil sections 111 and 121 do not match each other on the both surfaces of the film base material 101. Specifically, the positions of the coils of the coil sections 111 and 121 do not match each other in a direction along the direction in which the film base material 101 moves at the time of manufacturing. By comparison of FIG. 5 and FIG. 6, it can be understood that capacitance of the coil sections 111 and 121 decreases when the antenna patterns 110 and 120 are not formed on the locations desired at the time of manufacturing by comparison with the case where the antenna patterns 110 and 120 can be formed on the locations desired at the time of manufacturing.

Accordingly, the electrode sections 112 and 122 compensate the decrease in capacitance of the coil sections 111 and 121. As shown in FIG. 6, when the antenna patterns 110 and 120 are not formed on the locations desired at the time of manufacturing, positions of the electrode sections 112 and 122 match each other on the both surfaces of the film base material 101. By matching positions of the electrode sections 112 and 122 on the both surfaces of the film base material 101, capacitance of the electrode sections 112 and 120 are generated.

As described above, when the antenna patterns 110 and 120 are not formed on the locations desired at the time of manufacturing, the RFID antenna 100 according to an embodiment of the present disclosure compensates a decrease in capacitance of the coil sections 111 and 121 for capacitance generated by the electrode sections 112 and 122. By providing the electrode sections 112 and 122, the RFID antenna 100 according to an embodiment of the present disclosure can suppress change in capacitance of the whole RFID antenna according to a state of forming the antenna patterns 110 and 120.

Figure 7:
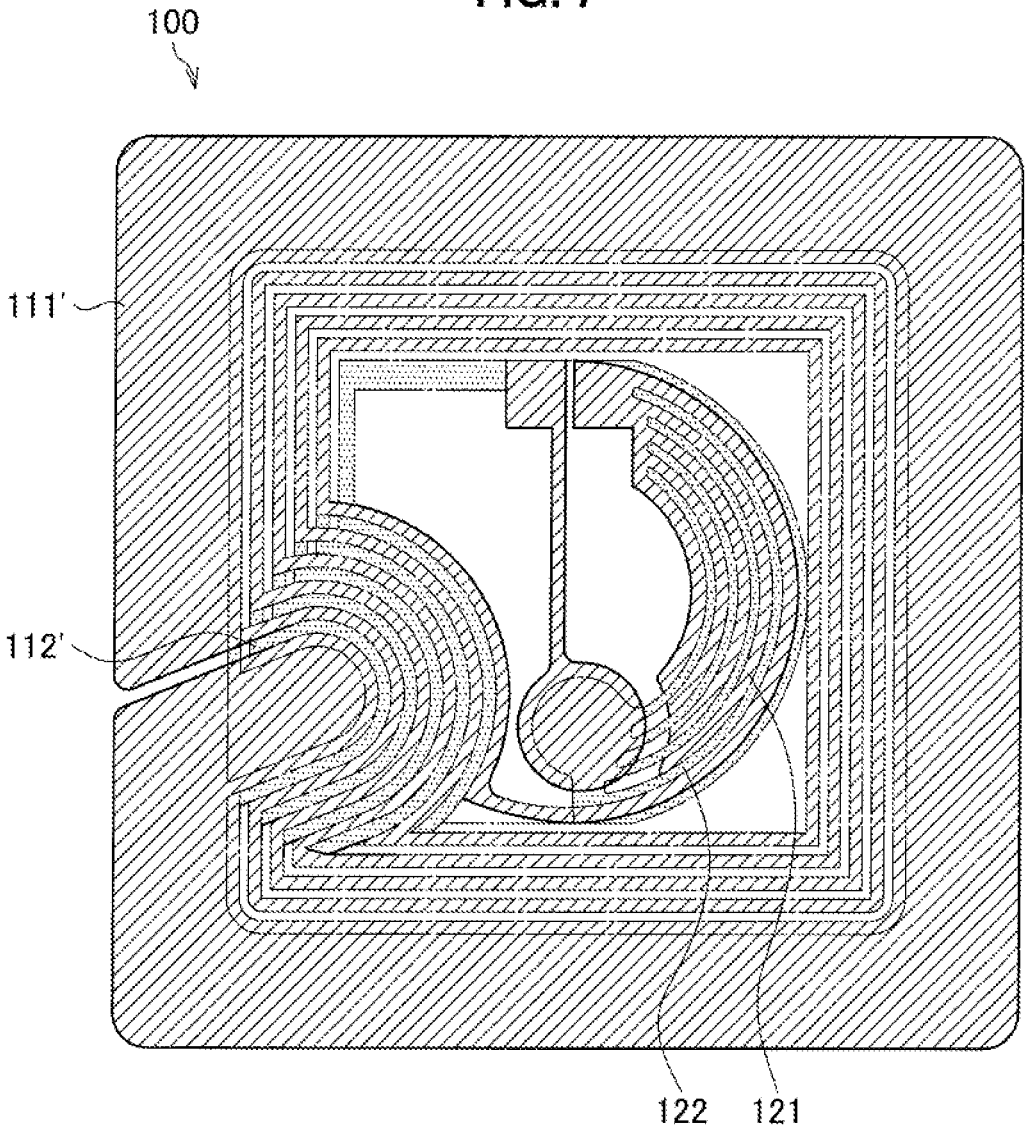
FIG. 7 is an explanatory diagram showing a modified example of an RFID antenna according to an embodiment of the present disclosure.

In the example shown in FIG. 4, coils of the coil sections 111 and 121 each have a substantially circular shape. However, the present disclosure is not limited thereto. FIG. 7 is an explanatory diagram showing a configuration example of an RFID antenna 100' that is a modified example of the RFID antenna according to an embodiment of the present disclosure. As shown in FIG. 7, coils of the coil sections 111' and 121' may each have a substantially rectangular shape. The shapes of the coil sections according to an embodiment of the present disclosure are of course not limited to the above examples. The coil sections may each have a shape other than the circular shape and the rectangular shape.

Although the electrode sections 112 and 122 are provided on inner sides of the coils of the coil sections 111 and 121 respectively in the example shown in FIG. 4, the present disclosure is not limited to the above example, and the electrode sections 112 and 122 may be provided on outer sides of the coils of the coil sections 111 and 121 respectively. However, it is preferable that the electrode sections 112 and 122 are provided on the inner sides of the coil sections 111 and 121 respectively in order not to enlarge the area of the antenna.

In the example shown in FIG. 4, the decrease in capacitance which may be generated according to a state of forming the coil sections 111 and 121 is compensated for capacitance generated by the electrode sections 112 and 122 in the case where the antenna patterns 110 and 120 are not formed on the locations desired at the time of manufacturing. However, the present disclosure is not limited thereto.

For example, in the RFID antenna 100 according to an embodiment of the present disclosure, capacitance of the electrode sections 112 and 122 are generated when the antenna patterns are formed accurately. However, in the case where positions of antenna patterns 110 and 120 deviate and are not formed accurately between the front surface and the back surface, the antenna patterns 110 and 120 in which capacitance of the electrode sections 112 and 122 decrease may be formed.

In the case where the positions of the antenna patterns 110 and 120 deviate and are not formed accurately between the front surface and the back surface and capacitance of the electrode sections 112 and 122 decrease, capacitance of the coil sections 111 and 121 is generated and change in capacitance of the whole RFID antenna 100 can be compensated.

The configuration examples of the RFID antennas according to embodiments of the present disclosure have been described above. Next, there will be described a method for manufacturing an RFID antenna according to an embodiment of the present disclosure.

[Example of Method for Manufacturing RFID Antenna]

Figure 8:
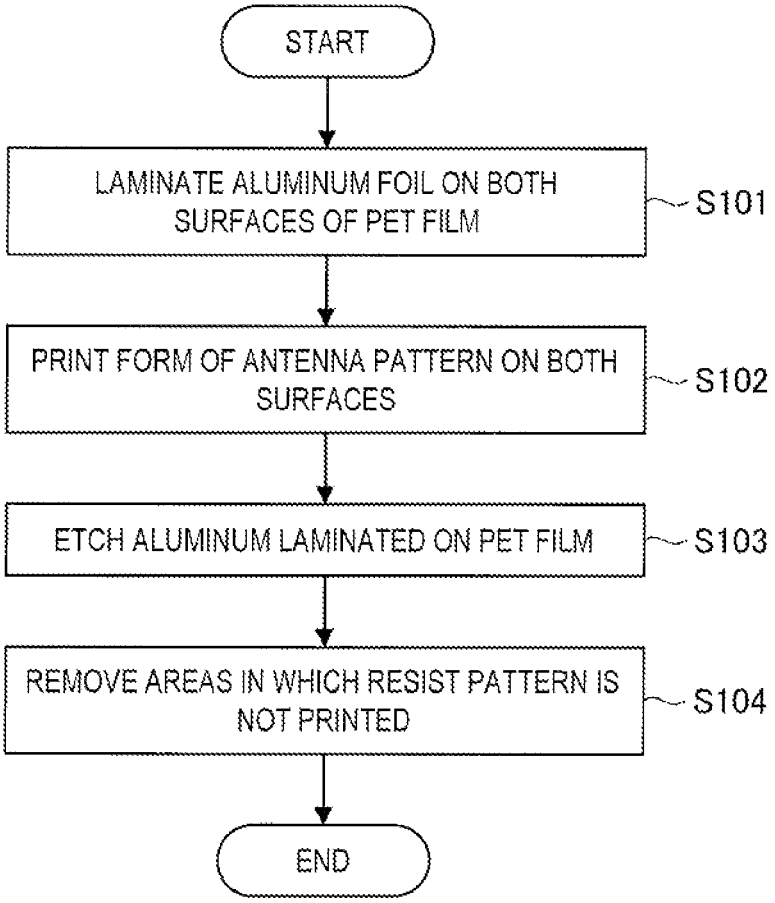
FIG. 8 is a flowchart showing a method for manufacturing an RFID antenna according to an embodiment of the present disclosure.

FIG. 8 is a flowchart showing a method for manufacturing an RFID antenna 100 according to an embodiment of the present disclosure. Hereinafter, there is described a method for manufacturing the RFID antenna 100 according to an embodiment of the present disclosure with reference to FIG. 8.

The flowchart shown in FIG. 8 shows a method for manufacturing the RFID antenna 100 when PET film is used as the film base material 101 and aluminum foil is used as the conductive foil. Materials of the film base material and the conductive foil are of course not limited to these examples. In addition, the RFID antenna 100 may be manufactured by the roll-to-roll method as described above.

First, aluminum foil having a predetermined thickness is laminated on the both surfaces of PET film having a predetermined thickness (step S101). Subsequently, forms of the antenna patterns 110 and 120 are printed by resist printing on the both surfaces of the PET film on which the aluminum foil is laminated (step S102). As described above, the antenna patterns 110 and 120 respectively includes the coil sections 111 and 121 and the electrode sections 112 and 122 as shown in FIG. 4. As described above, the electrode sections 112 and 122 compensates change in capacitance according to the state of forming the antenna patterns 110 and 120 in a direction in which the PET film moves.

After the antenna patterns 110 and 120 are printed in step S102, the aluminum laminated on the PET film in step S101 are etched (step S103). Finally, areas in which the resist pattern is not printed are removed by using the etching solution such as iron oxides (step S104).

The RFID antenna 100 according to an embodiment of the present disclosure is manufactured by the manufacturing method as shown in FIG. 8. it is possible to suppress change in capacitance of the whole RFID antenna according to the state of printing the antenna patterns 110 and 120 in step S102.

With reference to FIG. 8, the method for manufacturing the RFID antenna 100 according to an embodiment of the present disclosure has been described above. Next, there will be described an example of change in resonance frequency of the RFID antenna 100 according to an embodiment of the present disclosure by comparison with an existing general RFID antenna.

[Example of Change in Resonance Frequency]

FIG. 9 is an explanatory diagram that compares and shows changes in resonance frequency and capacitance of the existing general RFID antenna shown in FIG. 2 and the RFID antenna 100 according to an embodiment of the present disclosure as shown in FIG. 4.

As shown in FIG. 9, in the case of the existing general RFID antenna, capacitance of the whole antenna changes in a range of about 6 pF and the resonance frequency of the whole antenna changes in a range of about 2.65 MHz due to formation deviation of ±0.5 mm based on an assumption about process capability during mass production.

On the other hand, as shown in FIG. 9, in the case of the RFID antenna 100 according to an embodiment of the present disclosure, capacitance of the whole antenna changes in a range of about 1 pF and the resonance frequency of the whole antenna changes in a range of about 500 kHz due to formation deviation of ±0.5 mm based on an assumption about process capability during mass production. In other words, the RFID antenna 100 according to an embodiment of the present disclosure can suppress change in capacitance of the whole antenna to about ⅙ and can suppress change in resonance frequency of the whole antenna under ⅕ by comparison with the existing general RFID antenna.

The RFID antenna 100 according to an embodiment of the present disclosure can suppress change in capacitance of the whole antenna by using the electrode sections 112 and 122. Accordingly, the RFID antenna 100 can be provided as an RFID antenna with low cost and high productivity.

The above-described RFID antenna 100 according to embodiments of the present disclosure may form an inlet by being connected with an IC chip. By laminating the inlet on a film or paper, an RFID tag can be manufactured. Accordingly, the RFID tag using the RFID antenna 100 according to embodiments of the present disclosure can suppress change in resonance frequency according to formation deviation attributed to process capability during mass production.

In addition, it is possible to provide a communication device including the RFID antenna 100 according to embodiments of the present disclosure. For example, the communication device including the RFID antenna 100 according to embodiments of the present disclosure may be an RFID tag including the RFID antenna 100 and an IC card including the RFID antenna 100 as described above.

3. Conclusion

As described above, the embodiments of the present disclosure provide the RFID antenna 100 that compensates change in capacitance of the coil sections 111 and 121 for the electrode sections 112 and 122 formed on the both surfaces of the film base material 101, the change occurring from deviation in printing the antenna patterns 110 and 120 on the film base material 101.

The RFID antenna 100 according to embodiments of the present disclosure can suppress change in capacitance of the whole antenna by forming the electrode sections 112 and 122 on the both surfaces of the film base material 101. Since the RFID antenna 100 according to embodiments of the present disclosure can suppress change in capacitance of the whole antenna, change in resonance frequency can also be suppressed. Accordingly, the RFID antenna 100 according to embodiments of the present disclosure can have stable communication range for communicating with a reader/writer, even if deviation in forming the antenna patterns attributed to process capability during mass production occurs.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A non-contact communication antenna including:

a first antenna pattern that is formed on one surface of a base material; and a second antenna pattern that is formed on a back surface of the one surface of the base material, wherein the first antenna pattern includes a first coil section and a first electrode section, wherein the second antenna pattern includes a second coil section and a second electrode section, wherein capacitance of the first electrode section and the second electrode section compensates a change in capacitance depending on a formation situation of the first coil section and the second coil section.

(2) The non-contact communication antenna according to (1), wherein capacitance lost by non-correspondence between a position of the first coil section and a position of the second coil section is compensated for capacitance generated by the first electrode section and the second electrode section.

(3) The non-contact communication antenna according to (1), wherein capacitance lost by the first electrode section and the second electrode section is compensated for capacitance generated by correspondence between a position of the first electrode section and a position of the second electrode section.

(4) The non-contact communication antenna according to any one of (1) to (3), wherein the first coil section and the second coil section each have a substantially circular shape.

(5) The non-contact communication antenna according to any one of (1) to (3), wherein the first coil section and the second coil section each have a substantially rectangular shape.

(6) The non-contact communication antenna according to any one of (1) to (5), wherein the first electrode section and the second electrode section are formed on an inner side of the first coil section and an inner side of the second coil section, respectively.

(7) The non-contact communication antenna according to any one of (1) to (6), wherein the first coil section has a diameter larger than a diameter of the second coil section.

(8) The non-contact communication antenna according to any one of (1) to (7), wherein the first antenna pattern and the second antenna pattern are formed by resist printing.

(9) The non-contact communication antenna according to any one of (1) to (8), wherein the non-contact communication antenna is formed by a roll-to-roll method.

(10) The non-contact communication antenna according to (9), wherein the first electrode section and the second electrode section compensate a change in capacitance depending on a formation situation of the first antenna pattern and the second antenna pattern in a flow direction of the base material.

(11) A communication device including:

the non-contact communication antenna according to any one of (1) to (10).

(12) A method for manufacturing a non-contact communication antenna, the method including:

forming, on one surface of a base material, a first antenna pattern having a first coil section and a first electrode section; and forming, on a back surface of the one surface of the base material, a second antenna pattern having a second coil section and a second electrode section, wherein the first electrode section formed in the first-antenna-pattern forming step and the second electrode section formed in the second-antenna-pattern forming step compensate a change in capacitance depending on a formation situation of the first coil section and the second coil section in the first-antenna-pattern forming step and the second-antenna-pattern forming step.

(13) The method for manufacturing a non-contact communication antenna according to (12), wherein the non-contact communication antenna is formed by a roll-to-roll method.

14. The method for manufacturing a non-contact communication antenna according to (13), wherein the first electrode section and the second electrode section compensate a change in capacitance depending on a formation situation of the first antenna pattern and the second antenna pattern in a moving direction of the base material.

What is claimed is:

1. A non-contact communication antenna, comprising: a first antenna pattern on one surface of a base material, and a second antenna pattern on a back surface of the base material, wherein the first antenna pattern includes a first coil section and a first electrode section that includes a first plurality of elongated electrode portions, wherein the second antenna pattern includes a second coil section and a second electrode section that includes a second plurality of elongated electrode portions, wherein, for a first position of the first coil section on the one surface that matches with a second position of the second coil section on the back surface, each of the first plurality of elongated electrode portions of the first electrode section on the one surface is formed to non-overlap each of the second plurality of elongated electrode portions of the second electrode section formed on the back surface, and wherein a change in capacitance of the first electrode section and the second electrode section compensates for a change in capacitance of the first coil section and the second coil section.

2. The non-contact communication antenna according to claim 1, wherein sum of the capacitance of the first coil section and the second coil section and the capacitance of the first electrode section and the second electrode section corresponds to capacitance of the non-contact communication antenna, and wherein capacitance lost by increase in a difference between the first position of the first coil section and the second position of the second coil section is compensated by the capacitance increased by decrease in a difference between a position of the first plurality of elongated electrode portions of the first electrode section and a position of the second plurality of elongated electrode portions of the second electrode section.

3. The non-contact communication antenna according to claim 2, wherein capacitance lost by increase in the difference between the position of the first plurality of elongated electrode portions of the first electrode section and the position of the second plurality of elongated electrode portions of the second electrode section is compensated by increase in capacitance generated by decrease in the difference between the first position of the first coil section and the second position of the second coil section.

4. The non-contact communication antenna according to claim 1, wherein the first coil section has a first circular shape and the second coil section has a second circular shape.

5. The non-contact communication antenna according to claim 1, wherein the first coil section has a first rectangular shape and the second coil section has a second rectangular shape.

6. The non-contact communication antenna according to claim 1, wherein the first plurality of elongated electrode portions of the first electrode section are on a first inner side of the first coil section and the second plurality of elongated electrode portions of the second electrode section are on a second inner side of the second coil section.

7. The non-contact communication antenna according to claim 1, wherein a first diameter of the first coil section is larger than a second diameter of the second coil section.

8. The non-contact communication antenna according to claim 1, wherein the first antenna pattern and the second antenna pattern are formed by resist printing.

9. The non-contact communication antenna according to claim 1, wherein the non-contact communication antenna is formed by a roll-to-roll method.

10. The non-contact communication antenna according to claim 9, wherein, a change in the capacitance of the first electrode section and the second electrode section compensates for a change in the capacitance of the first antenna pattern and the second antenna pattern, based on a formation situation of the first antenna pattern and the second antenna pattern in a flow direction of the base material.

11. A communication device, comprising:

a non-contact communication antenna which comprises:

a first antenna pattern on one surface of a base material; and a second antenna pattern on a back surface of the base material, wherein the first antenna pattern includes a first coil section and a first electrode section that includes a first plurality of elongated electrode portions, wherein the second antenna pattern includes a second coil section and a second electrode section that includes a second plurality of elongated electrode portions, wherein, for a first position of the first coil section on the one surface that matches with a second position of the second coil section on the back surface, each of the first plurality of elongated electrode portions of the first electrode section on the one surface is formed to non-overlap each of the second plurality of elongated electrode portions of the second electrode section formed on the back surface, and wherein a change in capacitance of the first electrode section and the second electrode section compensates for a change in capacitance of the first coil section and the second coil section.

12. A method for manufacturing a non-contact communication antenna, the method comprising:

forming, on one surface of a base material, a first antenna pattern having a first coil section and a first electrode section that includes a first plurality of elongated electrode portions; and forming, on a back surface of the base material, a second antenna pattern having a second coil section and a second electrode section that includes a second plurality of elongated electrode portions, wherein, for a first position of the first coil section on the one surface that matches with a second position of the second coil section on the back surface, each of the first plurality of elongated electrode portions of the first electrode section on the one surface is formed to non-overlap each of the second plurality of elongated electrode portions of the second electrode section formed on the back surface, and wherein a change in capacitance of the first electrode section and the second electrode section compensates for a change in capacitance of the first coil section and the second coil section.

13. The method for manufacturing the non-contact communication antenna according to claim 12, wherein the non-contact communication antenna is formed by a roll-to-roll method.

14. The method for manufacturing the non-contact communication antenna according to claim 13, wherein a change in the capacitance of the first electrode section and the second electrode section compensates for a change in the capacitance of the first antenna pattern and the second antenna pattern, based on a formation situation of the first antenna pattern and the second antenna pattern in a moving direction of the base material.

* * * * *